US012589964B2

(12) United States Patent
Canade et al.

(10) Patent No.: US 12,589,964 B2
(45) Date of Patent: Mar. 31, 2026

(54) DOG WASTE-BAG DISPENSING SYSTEM FOR ONE-HANDED USE

(71) Applicant: Fable Pets, Inc., New York, NY (US)

(72) Inventors: Jeremy Canade, New York, NY (US); Adam Michael Paskow, New York, NY (US); David Beau Sutton, New York, NY (US); Chris Pak, New York, NY (US); Arya Tabatabai, New York, NY (US)

(73) Assignee: Fable Pets, Inc., New York, NY (US)

( * ) Notice: Subject to any disclaimer, the term of this patent is extended or adjusted under 35 U.S.C. 154(b) by 91 days.

(21) Appl. No.: 18/485,197

(22) Filed: Oct. 11, 2023

(65) Prior Publication Data

US 2024/0116728 A1 Apr. 11, 2024

Related U.S. Application Data

(60) Provisional application No. 63/415,003, filed on Oct. 11, 2022.

(51) Int. Cl.
*B65H 16/00* (2006.01)
*B65H 75/16* (2006.01)

(52) U.S. Cl.
CPC ..... *B65H 16/005* (2013.01); *B65H 75/16* (2013.01); *B65H 2402/41* (2013.01); *B65H 2701/191* (2013.01)

(58) Field of Classification Search
USPC ..... 242/422.5
See application file for complete search history.

(56) References Cited

U.S. PATENT DOCUMENTS 2,752,106 A * 6/1956 Thompson ..... A61F 15/002 242/588
4,111,089 A * 9/1978 Montaruli ..... B65H 49/205 225/45
4,832,271 A * 5/1989 Geleziunas ..... A47K 10/3809 206/408
7,850,039 B1 * 12/2010 Tsengas ..... E01H 1/1206 221/45
2006/0118061 A1 * 6/2006 Edwards ..... B65H 35/10 119/795

(Continued)

FOREIGN PATENT DOCUMENTS

WO WO 2018/157901 * 9/2018

*Primary Examiner* — William A. Rivera
(74) *Attorney, Agent, or Firm* — Taylor Dykema PLLC; Eric Kleinertz

(57) ABSTRACT

A waste bag dispensing system comprising a base member defining a cavity configured to receive a waste bag roll, a cap configured to removably secure to the base member, a slit opening extending through the base member, a separator, and a securement means to secure the system to an object, such as a leash. The roll may comprise a plurality of waste bags in perforated connection around a hollow spool configured to removably receive a base friction post and a cap friction post, the friction posts applying a lateral pressure on the waste bag roll and a tab may apply pressure on an exterior of the roll. An end of the roll may extend through the slit opening towards the separator which may engage the perforated connection and permit the removal of one waste bag from the roll. The securement means may comprise a lateral and vertical stability means.

14 Claims, 6 Drawing Sheets

(56) References Cited

U.S. PATENT DOCUMENTS

| | | | | |
|---|---|---|---|---|
| 2006/0118569 | A1* | 6/2006 | Edwards | B65H 35/10 242/590 |
| 2006/0180608 | A1* | 8/2006 | Edwards | E01H 1/1206 222/105 |
| 2009/0151645 | A1* | 6/2009 | Fangsrud | B65F 1/1468 119/161 |
| 2011/0284544 | A1* | 11/2011 | Davies | B65F 1/062 220/315 |
| 2015/0001332 | A1* | 1/2015 | Qin | B65H 16/005 242/598.3 |
| 2019/0202649 | A1* | 7/2019 | Wurtz | B65H 16/005 |
| 2020/0305395 | A1* | 10/2020 | Haarburger | E01H 1/1206 |
| 2020/0352291 | A1* | 11/2020 | Feldman | B65H 35/00 |
| 2023/0242298 | A1* | 8/2023 | Zeitz | B65D 51/28 119/161 |
| 2024/0141605 | A1* | 5/2024 | Doerr | E01H 1/1206 |
| 2024/0400299 | A1* | 12/2024 | Vizzio | E01H 1/1206 |
| 2025/0091794 | A1* | 3/2025 | Vizzio | B65D 83/0805 |

* cited by examiner

DOG WASTE-BAG DISPENSING SYSTEM FOR ONE-HANDED USE

CROSS-REFERENCE TO RELATED APPLICATIONS

The present application claims the benefit of U.S. Patent Application No. 63/415,003 for Dog Waste-Bag Dispensing System for Easy One-Handed Use, filed Oct. 11, 2022, the entire contents of which are incorporated herein by reference in their entirety.

FIELD OF THE INVENTION

The present disclosure is directed to a waste-bag dispensing system. More specifically, the present disclosure is directed to an animal waste-bag dispending system capable of being operated by one hand.

INTRODUCTION

When one walks a dog and has to pick up the dog's feces, one often has only one hand available to grab a waste bag and pick up the feces. The other hand is often occupied holding a leash to maintain control of the dog, holding a phone or bag, or otherwise occupied. Quickly and easily accessing the waste bag with one hand can be challenging. Typically, one needs two hands in order to remove the waste bag from the holder and separate it from the other bags on the roll. Using only one hand to pull at a bag on a roll, may cause multiple bags to unravel from the roll, stretch or tear the bag making it unusable, and/or the bag will fail to detach from the roll. Once the bag is removed from the roll, opening the bag often presents a further challenge requiring two hands to address.

Generally, when one pulls on the waste bag roll with one hand, one must use the other hand to hold the roll or the roll holder and detach the bag from remaining bags on the roll. Current proposals lack mechanisms to quickly and easily detach a bag from the roll or to stabilize and control the bag and holder to allow one to properly pull on the bag to detach it, without unraveling multiple bags or stretching or tearing the bag.

Thus, there is a need for a waste bag dispensing system that can store a roll of waste bags that may be secured to a leash to improve lateral and vertical stability.

There is also a need for a waste bag dispensing system to stabilize and control the dispensing of the waste bags.

There is a further need for a waste bag dispensing system to control the orientation of the waste bags as they exit the system to permit removal from the waste bag roll.

There is still another need for a waste bag dispensing system to permit the removal of the waste bag from another waste bag in the roll.

SUMMARY

This Summary is provided to introduce a selection of concepts in a simplified form that are further described below in the Detailed Description. This Summary is not intended to identify key features or essential features, nor is it intended to limit the scope of the claims included herewith.

Provided may be a waste bag dispensing system for improved access to waste bags during normal activities. The waste bag dispensing system may comprise a base member configured to receive a waste bag roll, a cap, a slit opening extending though the base member, a tab configured to apply pressure to an exterior of the waste bag roll, a separator, and a securement means. The base member may comprise a base and a sidewall extending off the base wherein an inner surface of the sidewall defines the cavity. An upper edge of the sidewall may be configured to removably engage the cap. The slit opening may extend through the sidewall to permit an end of the waste bag roll to extend through the slit opening. The separator may be located on an outer surface of the sidewall positioned adjacent to the slit opening.

In one embodiment, the base member may comprise a base friction post extending from the base into the cavity. In a further embodiment, the cap may comprise a cap friction post extending off an inner surface of the cap towards the cavity, when secured.

In an embodiment, the securement means may be configured to secure the base member to a desired object. The desired object may be any object that a person of ordinary skill may desire, including without limitation, a leash or a bag strap. Reference is made throughout to securing to the leash in the interest of brevity, however, the system may be utilized with any object that may be desired.

In one embodiment, the securement means may comprise a back loop extending off the outer surface of the sidewall. The back loop may extend from the upper edge of the sidewall to a lower edge of the sidewall and a back loop opening may be parallel to the sidewall and configured to receive the leash. It is contemplated that the back loop may provide lateral stability of the base member in reference to the leash.

In an embodiment, the securement means may comprise a top loop that extends from the base member past the cap when secured. The top loop may, in some embodiments, provide vertical stability to the base member in relation to the leash.

In one embodiment, the securement means may comprise the back loop and the top loop to promote stability of the base member in relation to the leash. It is contemplated that stabilizing the base member in relation to the leash may reduce dexterity required to remove a waste bag from the waste bag roll.

In an embodiment, the waste bag roll may comprise a plurality of waste bags in perforated connection to another of the waste bags in the roll around a hollow spool. The hollow spool may be sized to removably secure with and pivot about the base and cap friction posts. Of course, the system may be configured to receive any bag rolls that may be available in the art.

In an embodiment, an end of the waste bag roll may extend through the slit opening and the separator may be configured to engage the perforated connection between the waste bags in the roll. It is contemplated that tab may stabilize the waste bag roll, prevent internal unrolling, and control waste bag disbursement.

BRIEF DESCRIPTION OF THE DRAWINGS

The incorporated drawings, which are incorporated in and constitute a part of this specification exemplify the aspects of the present disclosure and, together with the description, explain and illustrate principles of this disclosure.

DETAILED DESCRIPTION

In the following detailed description, reference will be made to the accompanying drawing(s), in which identical functional elements are designated with like numerals. The aforementioned accompanying drawings show by way of illustration, and not by way of limitation, specific aspects, and implementations consistent with principles of this disclosure. These implementations are described in sufficient detail to enable those skilled in the art to practice the disclosure and it is to be understood that other implementations may be utilized and that structural changes and/or substitutions of various elements may be made without departing from the scope and spirit of this disclosure. The following detailed description is, therefore, not to be construed in a limited sense.

It is noted that description herein is not intended as an extensive overview, and as such, concepts may be simplified in the interests of clarity and brevity.

All documents mentioned in this application are hereby incorporated by reference in their entirety. Any process described in this application may be performed in any order and may omit any of the steps in the process. Processes may also be combined with other processes or steps of other processes.

Disclosed herein are systems and devices for waste bag dispensing. In an embodiment, the waste bag dispensing system provides a solution to dispensing of a single waste bag from a waste bag roll during use. In another embodiment, the waste bag dispensing system provides a solution to single-handed disbursement of waste bags.

Figure 1:
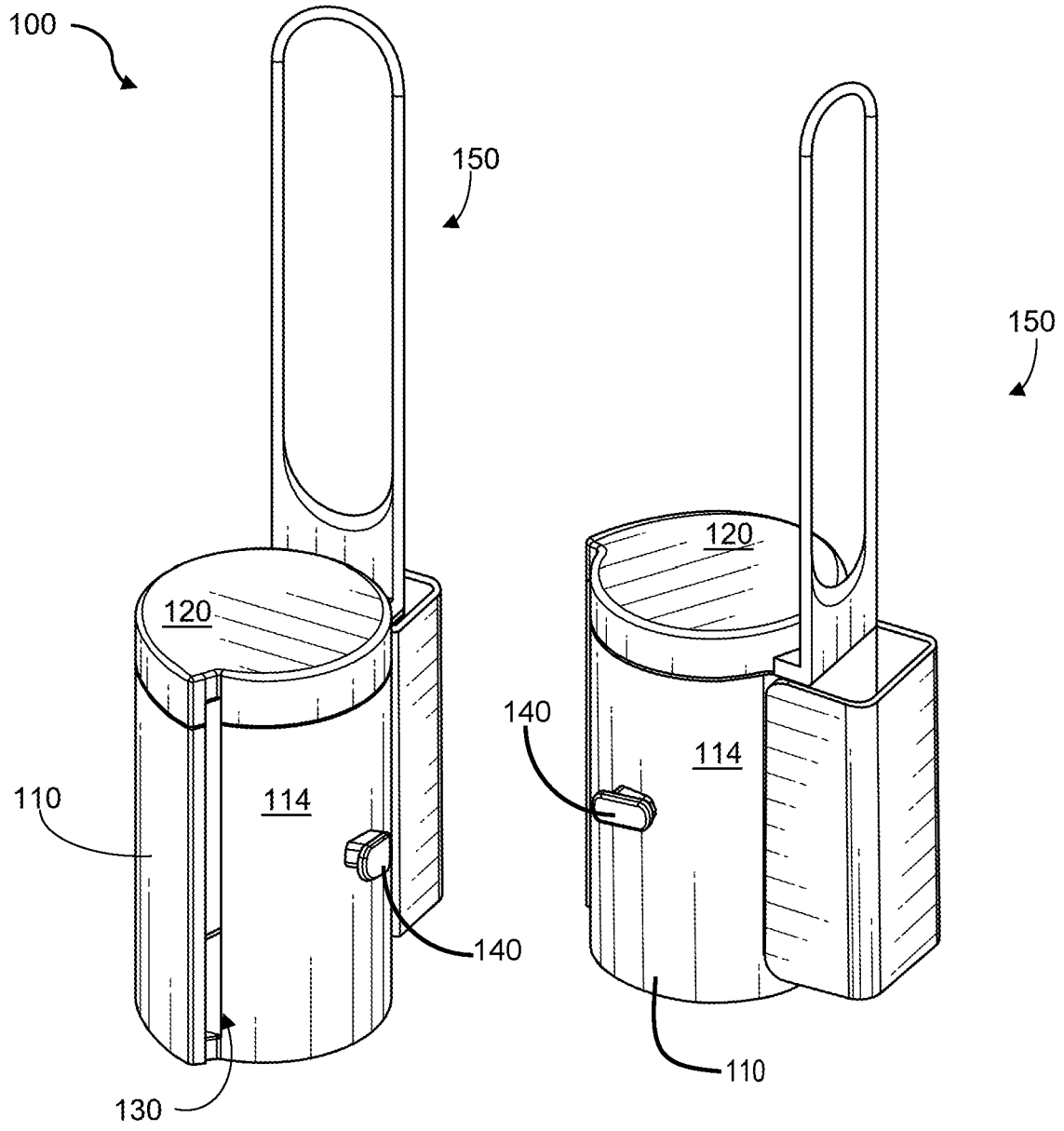
FIG. 1 is an illustration of an embodiment of the waste bag dispensing system.

Referring to FIG. 1, an embodiment of the waste bag dispensing system 100 is shown. The waste bag dispensing system 100 comprises a base member 110, a cap 120, a slit opening 130 extending through the base member 110, a separator 140, and a securement means 150.

Figure 2:
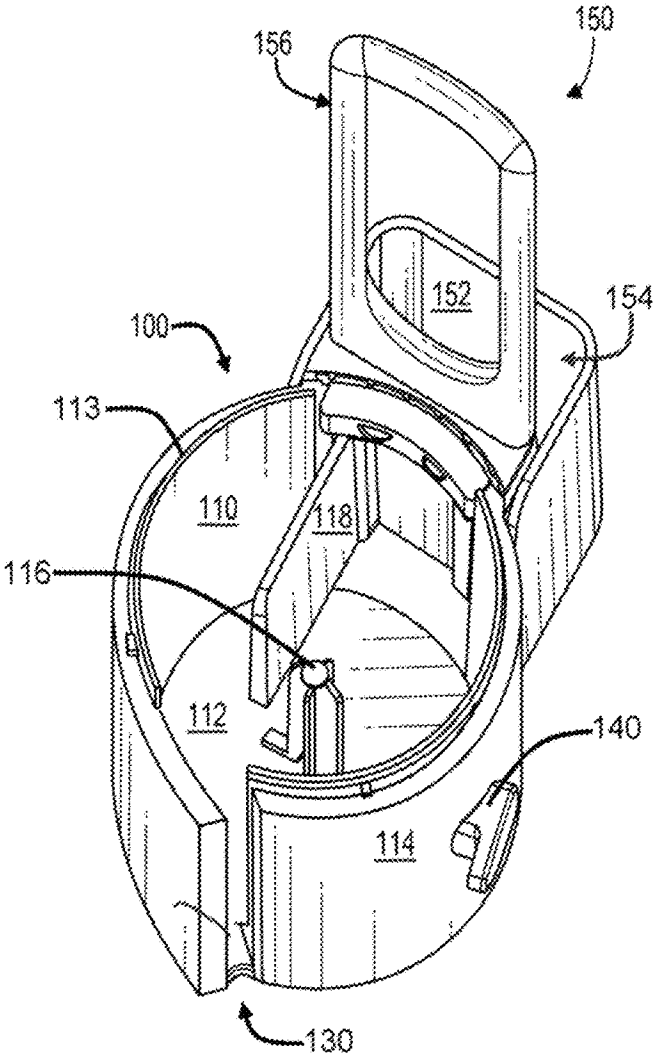
FIG. 2 is an illustration of an embodiment of the base member.

FIG. 2 illustrates one embodiment of the base member 100. The base member 100 may comprise a sidewall 114 extending from a base 112, each having an inner surface and an outer surface. The inner surface of the base 112 and sidewall 114 may define a cavity configured to receive a waste bag roll 300 shown in FIG. 3.

The sidewall 114 may comprise a first end securely joined to the base 112 and a second end configured to receive the cap 120, discussed in more detail with reference to FIG. 5. In the embodiment shown, the second end may be configured as a lip 113 configured to receive the cap 120.

Figure 3:
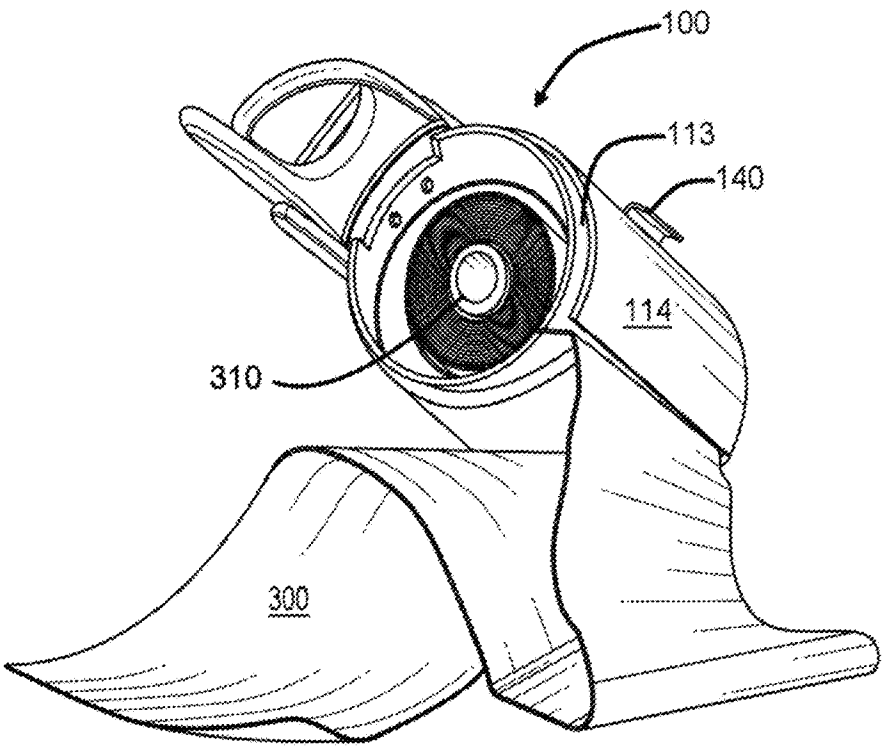
FIG. 3 is an illustration of an embodiment of the base member in use.

The base 112 may comprise a base friction post 116 extending upwards off the inner surface configured to receive the waste bag roll. In some embodiments, the waste bag roll 300 may comprise a hollow spool 310, as seen in FIG. 3, configured to receive the base friction post 116 as seen in FIG. 2.

In one embodiment, the base friction post 116 may comprise at least one flange extending along a length of the base friction post 116. As shown in FIG. 2, the at least one flange may comprise four flanges distributed around on the base friction post 116. It is contemplated that base friction post 116 may be operative to provide a lateral pressure on the hollow spool 310.

A tab 118 may extend off the inner surface of the sidewall 114. In some embodiments, the tab 118 may be positioned along the sidewall 114 such that it is offset to the base friction post 116. The tab 118 may, in one embodiment, be hingedly secured to the sidewall 114 to permit movement in a single plane to apply lateral pressure on an exterior of the object. As shown in FIG. 3, the tab (obscured) may apply pressure to the exterior of the waste bag roll 300 that may, in some embodiments, prevent the waste bag roll 300 from unspooling. In a further embodiment, the lateral pressure applied by the tab may control the rate of the disbursement of the waste bags. In yet another embodiment, the tab may be configured to hingedly move as the waste bag roll 300 reduces in diameter during use to apply continuous lateral pressure on the outer of the waste bag roll. It is contemplated that the continuous application of lateral pressure to the waste bag roll 300 may stabilize the waste bag roll about the base friction post.

In one embodiment, the tab may be malleable to shape to the exterior of the waste bag roll 300. For example, the tab may be formed of silicone. However, in another embodiment, the tab may be formed of any other material that, as understood by a person of ordinary skill in the start, is suitable for the aforementioned functionality.

Returning to FIG. 2, the slit opening 120 may extend through the sidewall 114. In the embodiment shown, the slit opening 120 may extend from an upper edge of the sidewall 114 to the base 112. In some embodiments, the slit opening may extend across less than an entire length of the sidewall.

In the embodiment shown in FIG. 2, the sidewall 114 may comprise an asymmetric shape wherein the slit opening 120 extends through the asymmetry. In one such embodiment, the sidewall 114 may comprise a generally cylindrical shape wherein, at the slit opening 130, the sidewall 114 may comprise a tangential portion abutting the slit opening 140. The tangential portion of the sidewall 114 may be configured to permit the end of the waste bag roll 300 to extend through the slit opening 130 along the outer surface of the sidewall 114. It is contemplated that the end of the waste bag roll 300 extending through along the outer surface of the sidewall 114 may improve contact with the separator 140 as discussed in further detail below.

As shown in FIG. 3, an end of the waste bag roll 300 may extend through the slit opening 130. In an embodiment, the slit opening 130 may be configured to permit the end of the waste bag roll 300 to extend through the slit opening 130 flat relative to the outer surface of the sidewall 114. It is contemplated that the end of the waste bag being configured to remain flat relative to the outer surface of the sidewall 114 when pulled may, in some embodiments, reduce undesired unraveling of the waste bag roll 300 within the cavity.

As shown in FIG. 2, the separator 140 may be positioned along outer surface of the sidewall 114 adjacent to the slit opening 130. In one embodiment, the separator 140 may comprise a base extending from the sidewall 114 and a hook extending from the base. The hook may be positioned to extend off the base towards the slit opening 130 to engage a seam connecting each waste bag to another waste bag in the waste bag roll 300. The seam may be a perforated connection between each waste bag to another waste bag in the waste bag roll 300. In one embodiment, the hook may extend at an upward angle from the base. Of course, the separator 140 may be configured in any manner to separate the waste bags as desired.

Figure 4:
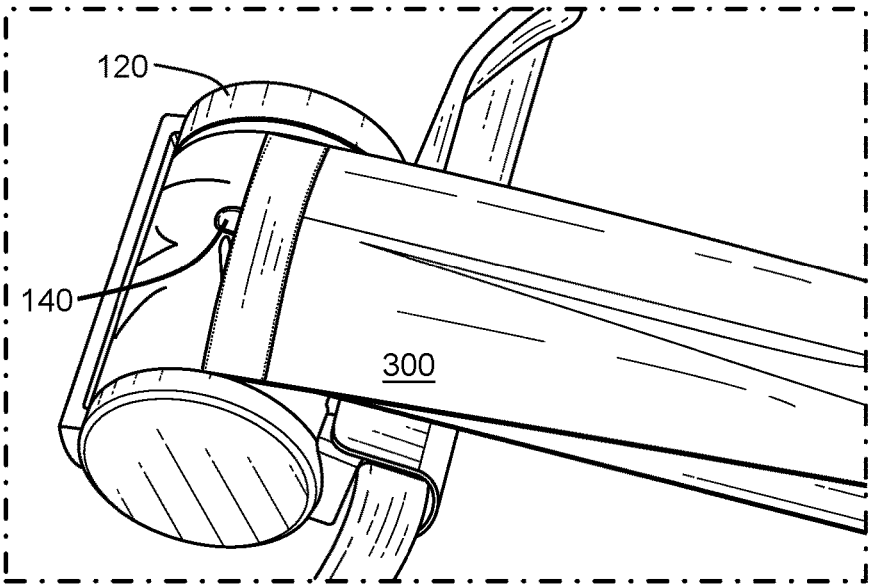
FIG. 4 is an illustration of an embodiment of the waste bag dispensing system in use.

One embodiment of the separator 140 in use is illustrated in FIG. 4. As illustrated, the separator 140 may penetrate the seam between waste bags in the waste bag roll 300. The separator 140 may penetrate the seam and, as a pulling force is applied to the end of the waste bag roll 300, the base of the separator 140 may retain the waste bag distal to the slit opening 130, and the perforated connection between the waste bags may be severed, permitting the removal of one waste bag from the waste bag roll 300. A person of ordinary skill in the art will recognize that the counter pressure applied by the separator 140 may permit the waste bag to be removed, without the need for external pressure applied to facilitate the severing of the perforation connection.

In some embodiments, the perforated connection may be varied along the seam. It is contemplated that varying the perforated connection may permit the separator 140 to engage a weak point of the seam to permit separation of one waste bag from another waste bag in the waste bag roll 300. In other embodiments, the perforated connection may be consistent along the seam and the separator 140 may be configured to engage the seam at any point.

It is contemplated that the separator being configured to engage the seam may reduce the stretching and puncturing of the waste bags.

The securement means 150 may comprise a back loop 152 extending off the base member 110 to define an opening 154. In one embodiment, the back loop 152 may extend from a portion the exterior surface of the sidewall 114. In a further embodiment, the back loop 152 may extend from a portion of the exterior surface of the sidewall 114 opposite to the slit opening 130.

In an embodiment, any of the back loop 152 may extend through the sidewall 114 into the cavity to secure the back loop 152 to the base member 110. In a further embodiment, the back loop 152 may form a continuous structure with the tab 118.

In one embodiment, the back loop 152 may extend from the first edge of the base member 110 to the second edge. The back loop opening 154 may be parallel to the cavity and configured to receive an object to be secured to.

In one embodiment, the back loop 152 may be removably secured to the base member 110. In other embodiments, the back loop 152 may be permanently secured to the base member 110.

In a further embodiment, the securement means 150 may comprise a top loop 156 extending upward from the base member 110. In one embodiment, the top loop 156 may extend off the sidewall 114. In another embodiment, the top loop 156 may extend off a portion of the base loop 152. In yet a further embodiment, the top loop may extend off the cap.

Figure 7:
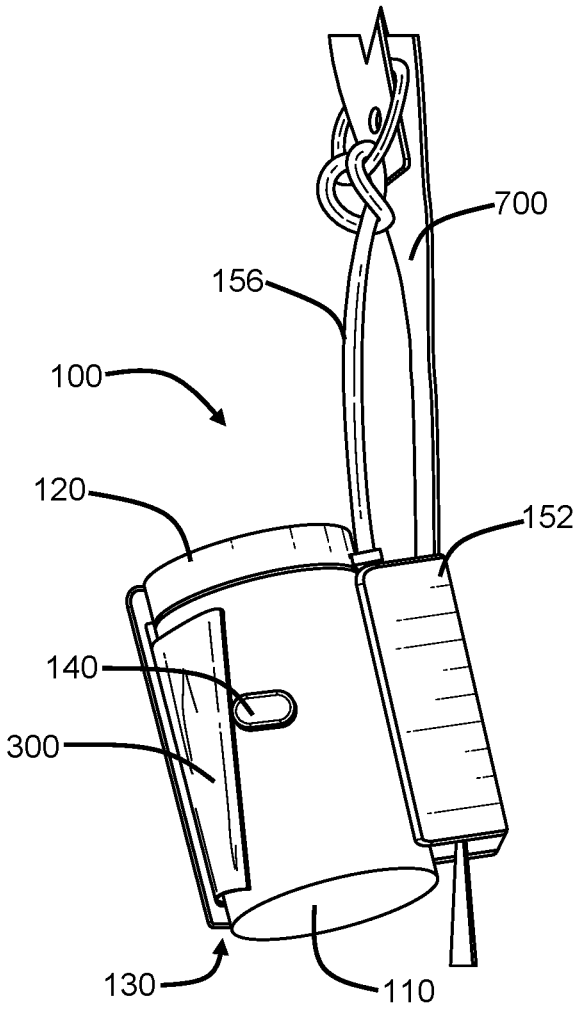
FIG. 7 is an illustration of an embodiment of the waste bag dispensing system in use.
Figure 8A:
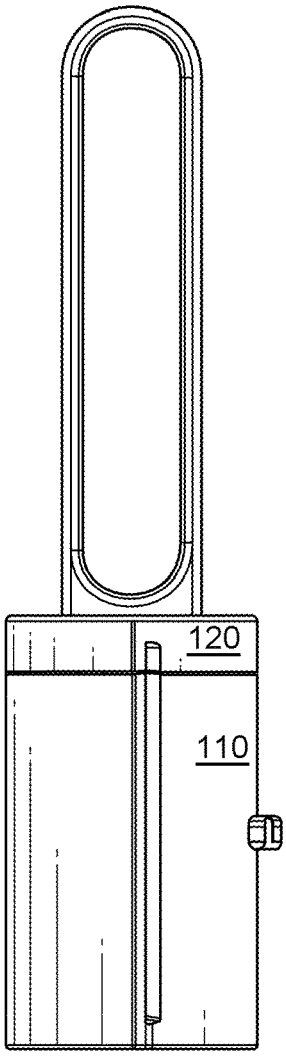
FIG. 8A is a front view illustration of an embodiment of the waste bag dispensing system.
Figure 8B:
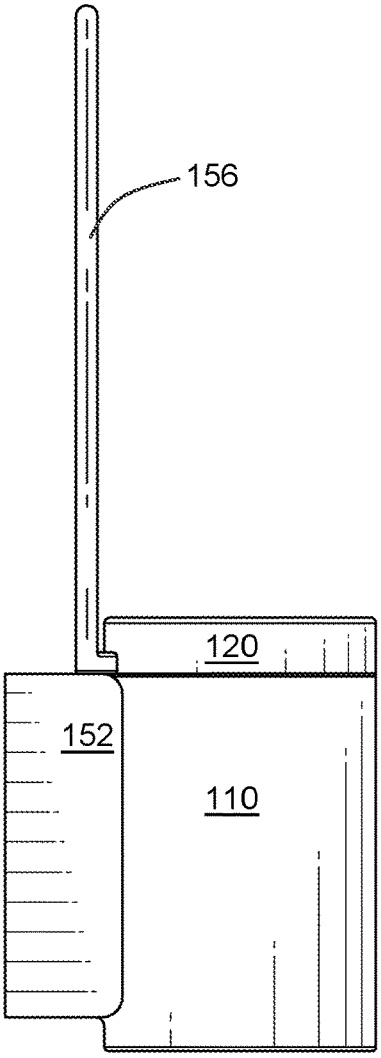
FIG. 8B is a side view illustration of an embodiment of the waste bag dispensing system.
Figure 8C:
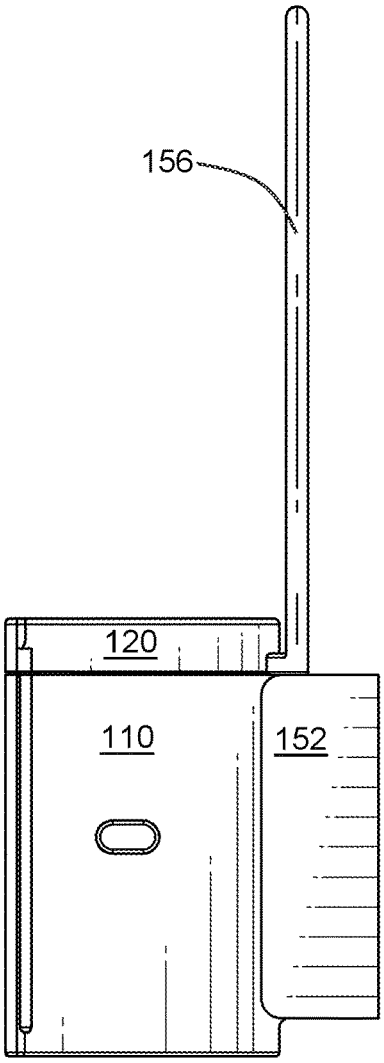
FIG. 8C is a side view illustration of an embodiment of the waste bag dispensing system.
Figure 9A:
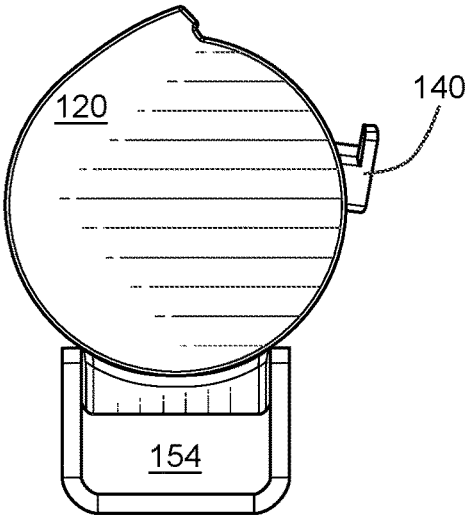
FIG. 9A is a bottom view illustration of an embodiment of the waste bag dispensing system.
Figure 9B:
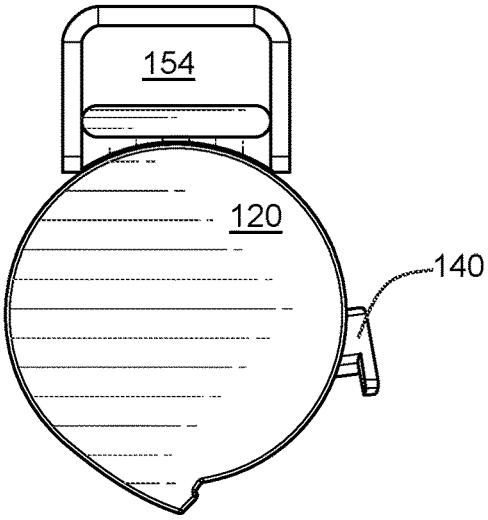
FIG. 9B is a top view illustration of an embodiment of the waste bag dispensing system.

An embodiment of the waste bag dispensing system 100 in use is shown in FIG. 7. In one embodiment, a leash 700 may extend through the back loop opening 154 and the top loop 156 may be configured to removably secure to a wrist loop of the leash 700 to secure the waste bag dispensing system 100 to the leash 700. In some embodiments, the leash 700 may extend through the back loop opening 154 and the top loop 156 may be secured the leash 700 using a D-ring or other attachment means on the leash. Of course, the waste bag dispensing system may be used in any number of configurations and the aforementioned use is provided as a nonlimiting example.

It is contemplated that securing the waste bag system 100 to the leash 700 with two attachment points, for example, the back loop 152 and the top loop 156 may be operative to anchor the waste bag system 100 about the leash 700. In some embodiments, the securement means 150 may stabilize the waste bag system 100 when forces are applied, such as when pulling on the end of the waste bag roll 300. In a further embodiment, the securement means 150 may control the waste bag system 100 during use.

Figure 5:
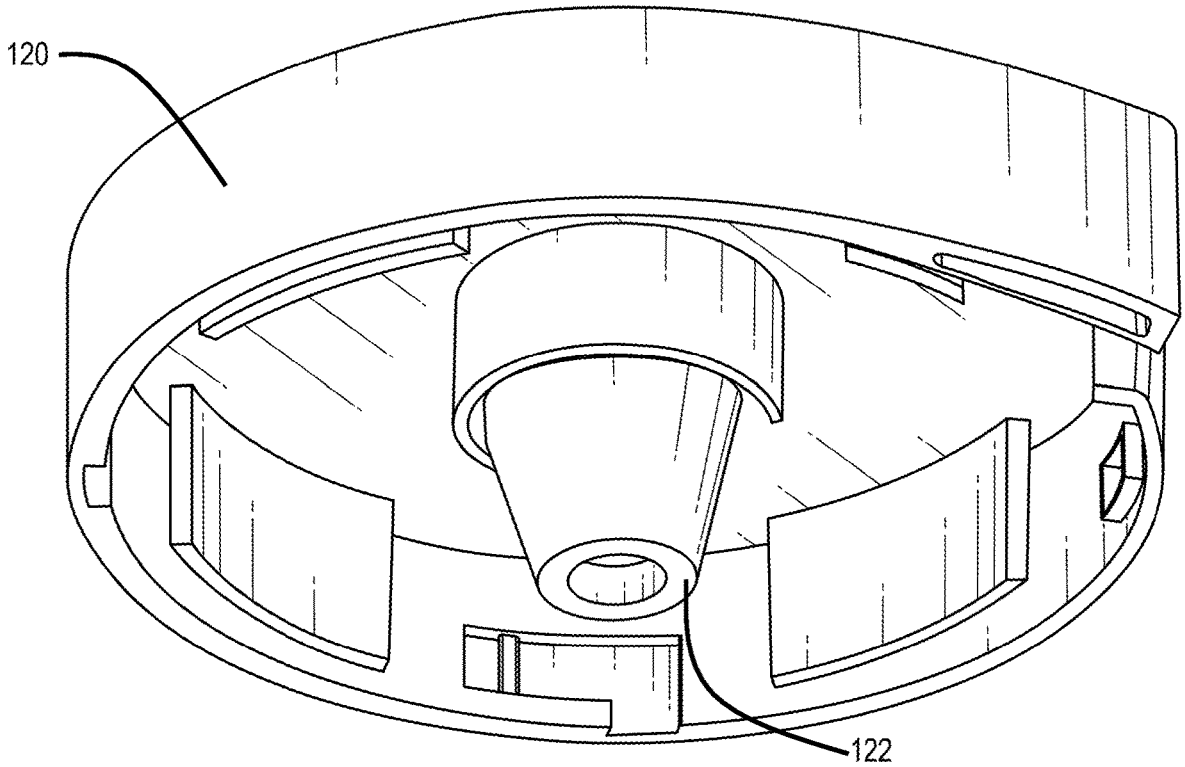
FIG. 5 is an illustration of an embodiment of the cap.

FIG. 5 illustrates one embodiment of the cap 120. In one embodiment, the cap 120 may comprise a means for securing the cap 120 to the lip 113 of the base member 110. In some embodiments, the cap 120 may be configured as a twist-cap. Of course, any manner of securing the cap to the upper end of the sidewall may be utilized and the aforementioned are provided as non-limiting examples only.

Figure 6B:
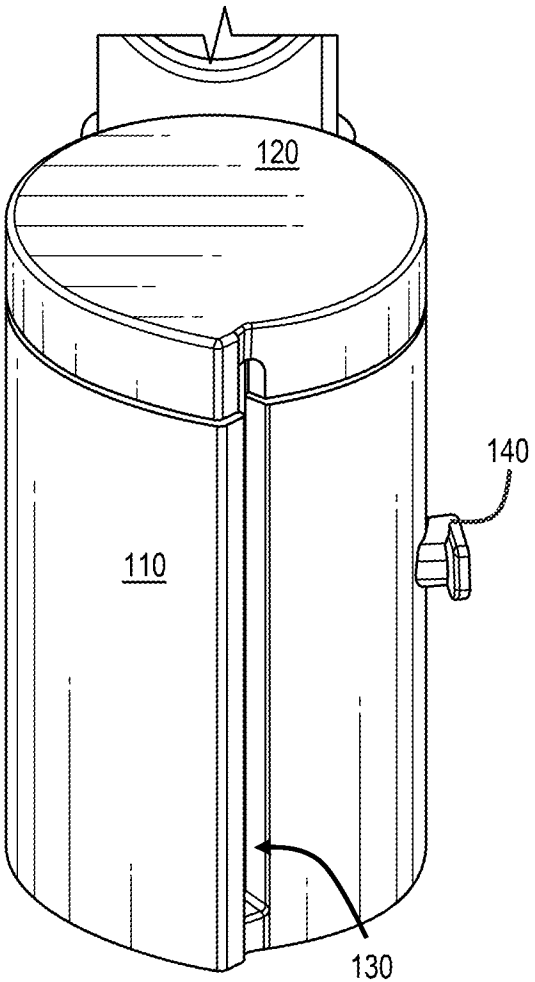
FIG. 6B is an illustration of an embodiment of the cap and the base member in a locked position.
Figure 6A:
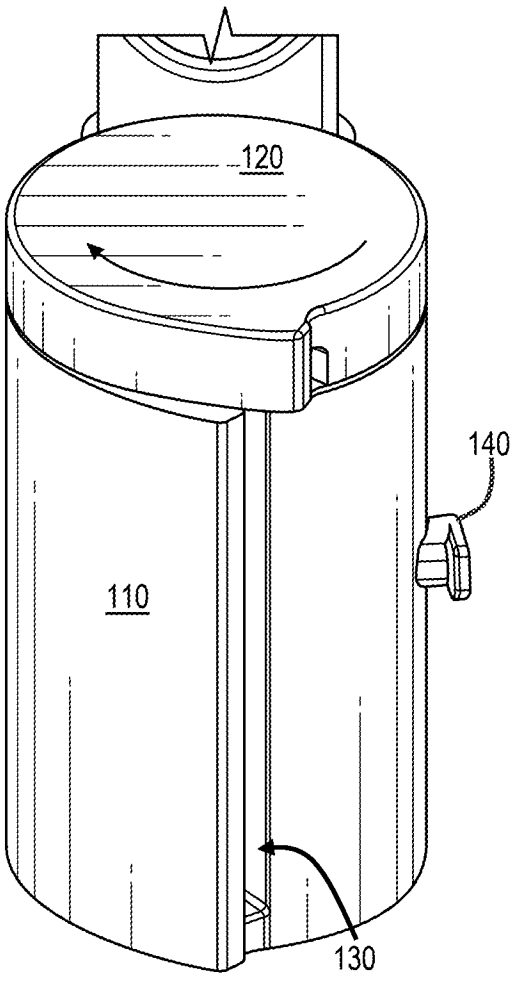
FIG. 6A is an illustration of an embodiment of the cap and the base member in an unlocked position.

As shown in FIG. 6A, the second end of the sidewall 114 may receive the cap 120 in an unlocked position. The cap 120 may be twisted about the second end to engage with the lip 113 to define a locked position. In one embodiment, the cap 120 may comprise snap-fit geometry and the lip 113 may comprise complementary snap-fit geometry. As shown in FIG. 5, in one embodiment, the cap 120 may comprise an inner flange and an outer flange configured to receive the lip 113. In a further embodiment, the cap 120 may comprise a depression on an inner surface of the outer flange configured to removably couple with a protrusion on the lip 113. Of course, any manner of removably securing the cap to the base member may be utilized.

Returning to the embodiment of the cap 120 illustrated in FIG. 5, the cap 120 may comprise a cap friction post 122 extending off an inner surface of the cap 120. More particularly, the cap friction post 122 may extend off a portion of the cap 120 in communication with the cavity, when secured. The hollow spool of the waste bag roll 300 may be configured to removably receive the cap friction post 122.

In some embodiments, the cap friction post 122 may be positioned to align with the base friction post 118. In one embodiment, the cap friction post 122 and the base friction post 118 may extend from a center-point of the cap 120 and base 112, respectively. In an embodiment, the hollow spool of the waste bag roll 300 may be configured to rotate about the cap friction post 122 and the base friction post 118.

As shown in FIG. 6, in one embodiment, the sidewall 114 may comprise the tangent portion and the cap 120 may comprise a tangent portion that may align with the tangent portion of the sidewall 144 when in the locked position. In one embodiment, the slit opening 130 may extend partially through the cap 120. However, in other embodiments, the slit opening 130 may be contained on the base member 110.

FIGS. 8A-C and 9A-B illustrate various perspectives of the waste bag dispensing system 100 as described herein.

The waste bag dispensing system 100 may be any size suitable for dispensing waste bags.

Finally, other implementations of the disclosure will be apparent to those skilled in the art from consideration of the specification and practice of the disclosure disclosed herein. It is intended that the specification and examples be considered as exemplary only, with a true scope and spirit of the ski closure being indicated by the following claims.

Various elements, which are described herein in the context of one or more embodiments, may be provided separately or in any suitable subcombination. Further, the processes described herein are not limited to the specific embodiments described. For example, the processes described herein are not limited to the specific processing order described herein and, rather, process blocks may be re-ordered, combined, removed, or performed in parallel or in serial, as necessary, to achieve the results set forth herein.

It will be further understood that the various changes in the details, materials, and arrangements of the parts that have been described and illustrated herein may be made by those skilled in the art without departing from the scope of the following claims.

All references, patents and patent application and publications that are cited or referred to in this application are incorporated in their entirety herein by reference. Finally, other implementations of the disclosure will be apparent to those skilled in the art from consideration of the specifications and practice of the disclosure disclosed herein. It is intended that the specification and examples be considered as exemplary only, with a true scope and spirit of the disclosure being indicated by the following claims.

What is claimed is:

1. A bag dispenser comprising:

a base member comprising a base and a sidewall extending upward from the base, each having an outer surface and an inner surface, wherein the inner surfaces of the base and the sidewall defines a cavity;

a cap configured to securely engage with the sidewall of the base member;

a slit opening extending through the sidewall;

a tab extending off the inner surface of the sidewall;

a separator disposed on the outer surface of the sidewall;

a base friction post positioned on the base within the cavity; and a cap friction post positioned on a portion of the cap in communication with the cavity, wherein when the cap is securely engaged with the sidewall, the base friction post and cap friction post are on opposing ends of the cavity.

2. The bag dispenser of claim 1, further comprising a securement means configured to secure the bag dispenser to an object.

3. The bag dispenser of claim 2, wherein the securement means of the bag dispenser is disposed on the outer surface of the base member opposite to the slit opening.

4. The bag dispenser of claim 2, wherein the securement means comprises a back loop extending along the sidewall of the base member and a top loop extending upwards from the base member.

5. The bag dispenser of claim 1, wherein an upper edge of the sidewall comprises a lip configured to receive the cap.

6. The bag dispenser of claim 5, wherein the cap is a snap-fit cap comprising snap-fit geometry and the lip comprises complementary snap-fit geometry.

7. The waste bag dispenser of claim 1, wherein the cavity of the base member is configured to receive a bag roll comprising a hollow spool configured to removably receive and rotate about the base and the cap friction posts, each bag in the roll in perforated attachment to another of the bags in the roll, and wherein an end of the bag roll extends through the slit opening, and the separator is configured to engage the perforated attachment to remove the bag from another of the bags.

8. A bag dispenser comprising, a base member comprising a base and a sidewall extending upward from the base, each having an outer surface and an inner surface, wherein the inner surfaces of the base and sidewall defines a cavity;

a cap configured to securely engage with the sidewall of the base member;

a slit opening extending through the sidewall;

a tab extending off the inner surface of the sidewall;

a separator disposed on the outer surface of the sidewall;

a base friction post positioned on the base within the cavity;

a cap friction post positioned on a portion of the cap in communication with the cavity, wherein when the cap is securely engaged with the sidewall, the base friction post and cap friction post are on opposing ends of the cavity;

a back loop extending along the sidewall of the base member; and a top loop extending upwards from the base member, wherein the cavity of the base member is configured to receive a bag roll comprising a hollow spool configured to removably receive and rotate about the base and the cap friction posts, each of bag in the roll in perforated attachment to another of the waste bags in the roll, and wherein an end of the bag roll extends through the slit opening and the separator is configured to engage the perforated attachment to remove the bag from another of the bags.

9. The bag dispenser of claim 8, wherein the back loop is disposed on the outer surface of the base member opposite to the slit opening.

10. The bag dispenser of claim 9, wherein the back loop extends along the sidewall from a lower edge of the sidewall to an upper edge of the sidewall.

11. The bag dispenser of claim 8, wherein an upper edge of the sidewall comprises a lip configured to receive the cap.

12. The bag dispenser of claim 11, wherein the cap is a snap-fit cap comprising snap-fit geometry and the lip comprises complementary snap-fit geometry.

13. The bag dispenser of claim 8, wherein the separator comprises a base extending off the outer surface of the sidewall and a hook extending off the base.

14. The bag dispenser of claim 8, wherein the tab is hingedly secured to the inner surface of the sidewall and configured to apply pressure to an exterior of the bag roll.

* * * * *